US010875551B2

(12) United States Patent
Kounoike et al.

(10) Patent No.: US 10,875,551 B2
(45) Date of Patent: Dec. 29, 2020

(54) RAILCAR BOGIE

(71) Applicant: KAWASAKI JUKOGYO KABUSHIKI KAISHA, Kobe (JP)

(72) Inventors: Fumikazu Kounoike, Kakogawa (JP); Yukitaka Taga, Kobe (JP); Takaya Ono, Kobe (JP); Yoshihiro Tamura, Kobe (JP); Kazuo Isomura, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/482,232

(22) PCT Filed: Jan. 23, 2018

(86) PCT No.: PCT/JP2018/001907
§ 371 (c)(1),
(2) Date: Jul. 30, 2019

(87) PCT Pub. No.: WO2018/139431
PCT Pub. Date: Aug. 2, 2018

(65) Prior Publication Data

US 2020/0047778 A1 Feb. 13, 2020

(30) Foreign Application Priority Data

Jan. 30, 2017 (JP) ..... 2017-013775

(51) Int. Cl.
*B61F 5/30* (2006.01)
*B61F 5/52* (2006.01)

(52) U.S. Cl.
CPC . *B61F 5/30* (2013.01); *B61F 5/52* (2013.01)

(58) Field of Classification Search
CPC .... B61F 5/302; B61F 5/32; B61F 5/46; B61F 5/52; B61F 3/02; B61F 5/305; B61F 5/325; B61F 5/36; B61F 5/50; F16C 11/02; F16C 11/04; F16C 9/02; F16C 9/04
USPC ..... 105/206.1, 206.2, 218.2
See application file for complete search history.

(56) References Cited

U.S. PATENT DOCUMENTS 4,750,718 A * 6/1988 Nickel ..... B60G 11/40 267/149
2015/0344046 A1* 12/2015 Nishimura ..... B61F 5/302 105/199.1
2015/0344047 A1 12/2015 Nishimura et al.

FOREIGN PATENT DOCUMENTS

JP 5878992 B2 3/2016

* cited by examiner

*Primary Examiner* — Mark T Le
(74) *Attorney, Agent, or Firm* — Oliff PLC

(57) ABSTRACT

A railcar bogie includes a plate spring supported by a pair of axle boxes arranged away from each other in a car longitudinal direction, the plate spring supporting a cross beam while being pressed by a pressing member of a bogie frame from above such that the pressing member is separable from the plate spring, at least a lower surface of the plate spring containing resin. The lower surface of the plate spring includes an inclined surface inclined with respect to a horizontal direction when viewed from a car width direction. The bogie frame includes at least one lifting supporting portion, the at least one lifting supporting portion including a supporting surface, the supporting surface being opposed to the inclined surface of the plate spring from below with a gap and inclined along the inclined surface of the plate spring.

12 Claims, 9 Drawing Sheets

RAILCAR BOGIE

TECHNICAL FIELD

The present invention relates to a railcar bogie.

BACKGROUND ART

Conventionally proposed is a railcar bogie in which plate springs extending in a car longitudinal direction are utilized as axle springs, and side sills of a bogie frame are omitted. For example, in a bogie of PTL 1, a pressing member provided at each of both car width direction end portions of a cross beam of a bogie frame is placed on a middle portion of a plate spring from above so as to be separable from the middle portion of the plate spring, the plate spring being supported by a pair of axle boxes and made of fiber-reinforced resin. According to this configuration, since the pressing member is placed on the plate spring so as not to be fixed to the plate spring, such structure is simple, and torsional force is hardly transferred between the bogie frame and the plate spring. Further, the bogie can be significantly reduced in weight.

CITATION LIST

Patent Literature

PTL 1: Japanese Patent No. 5878992

SUMMARY OF INVENTION

Technical Problem

When moving the bogie at the time of, for example, maintenance, the bogie needs to be lifted with a crane or the like in some cases. In such a case, there are a method of lifting the axle boxes and a method of lifting the bogie frame. In both cases, the bogie needs to be handled as one lifted load without being disassembled when the bogie is lifted. Therefore, in many cases, mechanisms, such as hanging hooks, for preventing the disassembling of the bogie when the bogie is lifted are provided at overlapping structural portions at which members are not fixed to each other. However, according to the bogie of PTL 1, the pressing member provided at the cross beam is not fixed to the plate spring, and mechanisms for realizing the lifting by the method of lifting the bogie frame are not provided. Therefore, if such bogie is lifted, the plate spring separates downward from the pressing member and hits a corner portion of a tip end portion of the axle beam. Thus, strong stress is locally generated at the plate spring made of fiber-reinforced resin, and this becomes a cause of the damage of the plate spring. When lifting the bogie, a lower surface of the plate spring may be protected by being covered with a protective member, such as a rubber plate. However, in this case, work of attaching and detaching the protective member is troublesome, and therefore, a work property of lifting the bogie deteriorates.

An object of the present invention is to provide a bogie capable of preventing a plate spring from being damaged while preventing a work property from deteriorating when the bogie is lifted by lifting a bogie frame.

Solution to Problem

A railcar bogie according to one aspect of the present invention includes: a bogie frame including a cross beam and pressing members, the pressing members being provided at both respective car width direction end portions of the cross beam; a plurality of axle boxes accommodating a plurality of bearings supporting a pair of axles; a plurality of coupling mechanisms coupling the plurality of axle boxes to the bogie frame; and a plate spring extending in a car longitudinal direction and supported by a pair of axle boxes arranged away from each other in the car longitudinal direction among the plurality of axle boxes, the plate spring supporting the cross beam while being pressed by the corresponding pressing member from above such that the pressing member is separable from the plate spring, at least a lower surface of the plate spring containing resin. The lower surface of the plate spring includes an inclined surface inclined with respect to a horizontal direction when viewed from a car width direction. The bogie frame includes at least one lifting supporting portion, the at least one lifting supporting portion including a supporting surface, the supporting surface being opposed to the inclined surface of the plate spring from below with a gap and inclined along the inclined surface of the plate spring.

According to the above configuration, when the bogie frame is lifted with a crane or the like, the inclined supporting surface of the lifting supporting portion of the bogie frame is brought into surface contact with the inclined surface of the lower surface of the plate spring. With this, the plate spring is stably supported, and the damage of the plate spring by local strong stress generated when the bogie frame is lifted can be prevented. In addition, since the work of attaching and detaching the protective member when lifting the bogie is unnecessary, the deterioration of the work property can be prevented.

Advantageous Effects of Invention

According to the present invention, when the bogie is lifted by lifting the bogie frame, the damage of the plate spring can be prevented while preventing the deterioration of the work property.

DESCRIPTION OF EMBODIMENTS

Hereinafter, embodiments will be explained with reference to the drawings. In the following description, a direction in which a railcar travels and a carbody extends is defined as a car longitudinal direction, and a lateral direction perpendicular to the car longitudinal direction is defined as a car width direction. The car longitudinal direction is also referred to as a front-rear direction, and the car width direction is also referred to as a left-right direction.

Embodiment 1

Figure 1:
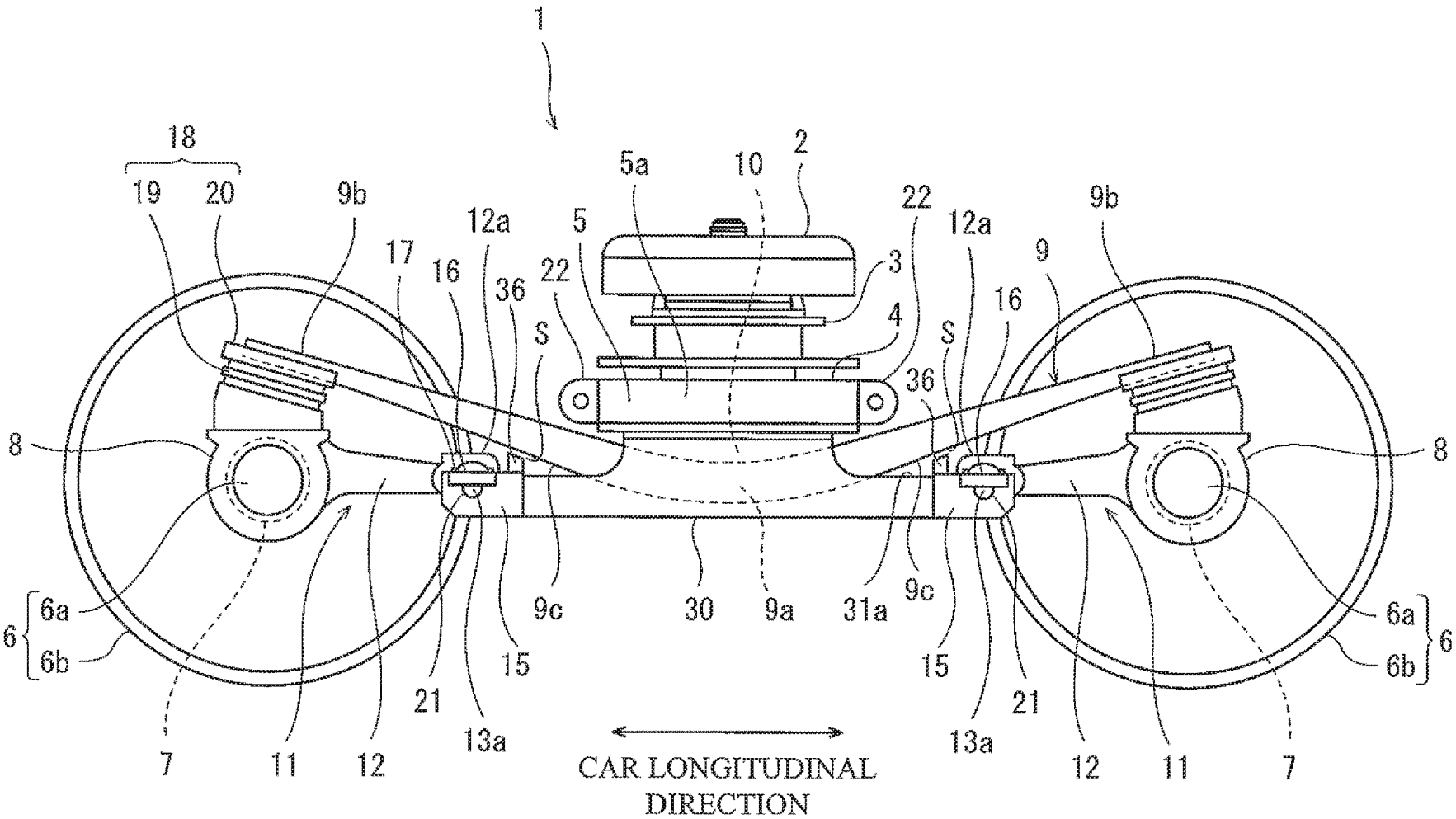
FIG. 1 is a side view of a railcar bogie according to Embodiment 1.
Figure 2:
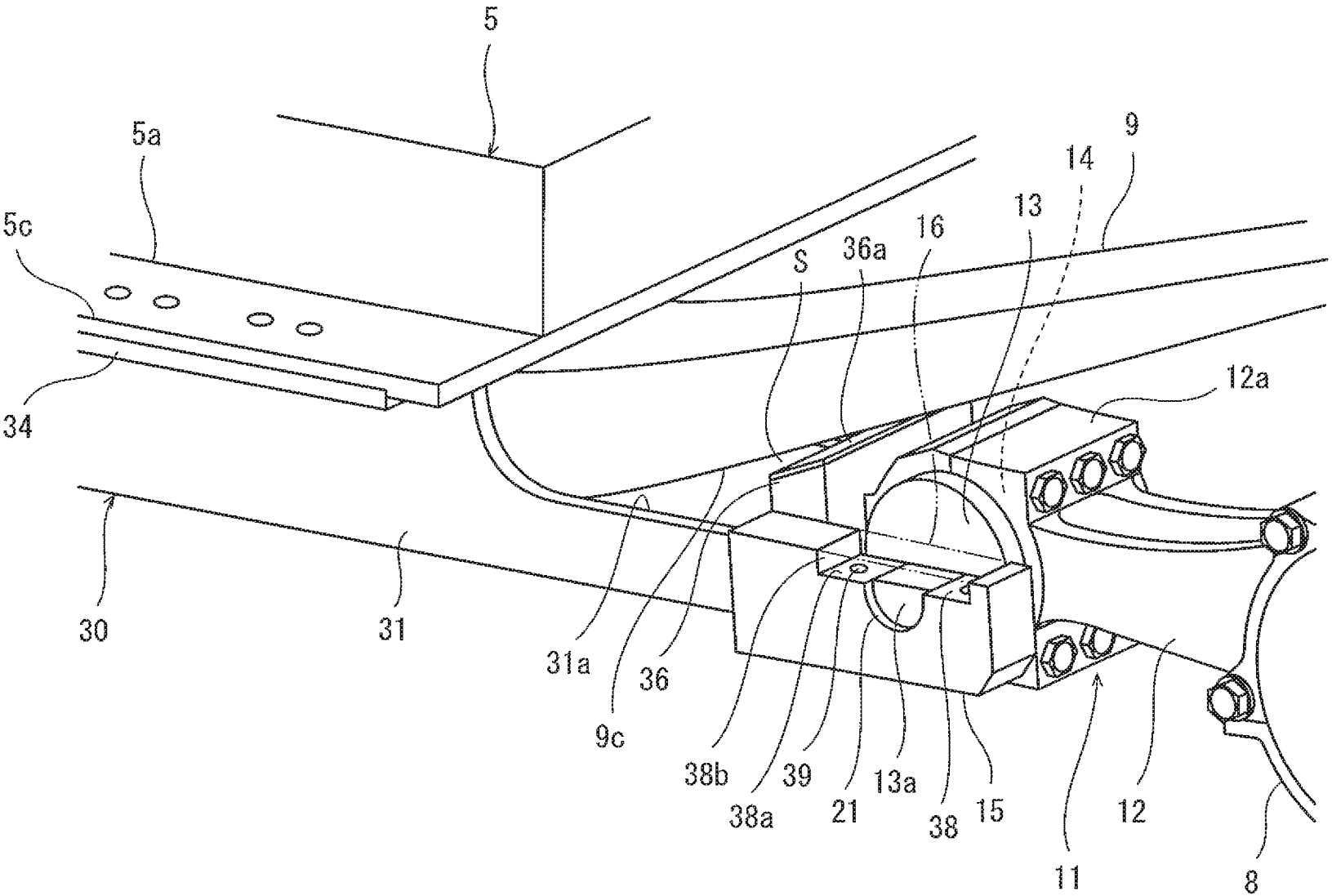
FIG. 2 is a perspective view when viewing a lifting supporting portion of FIG. 1 and its vicinity from above.
Figure 3:
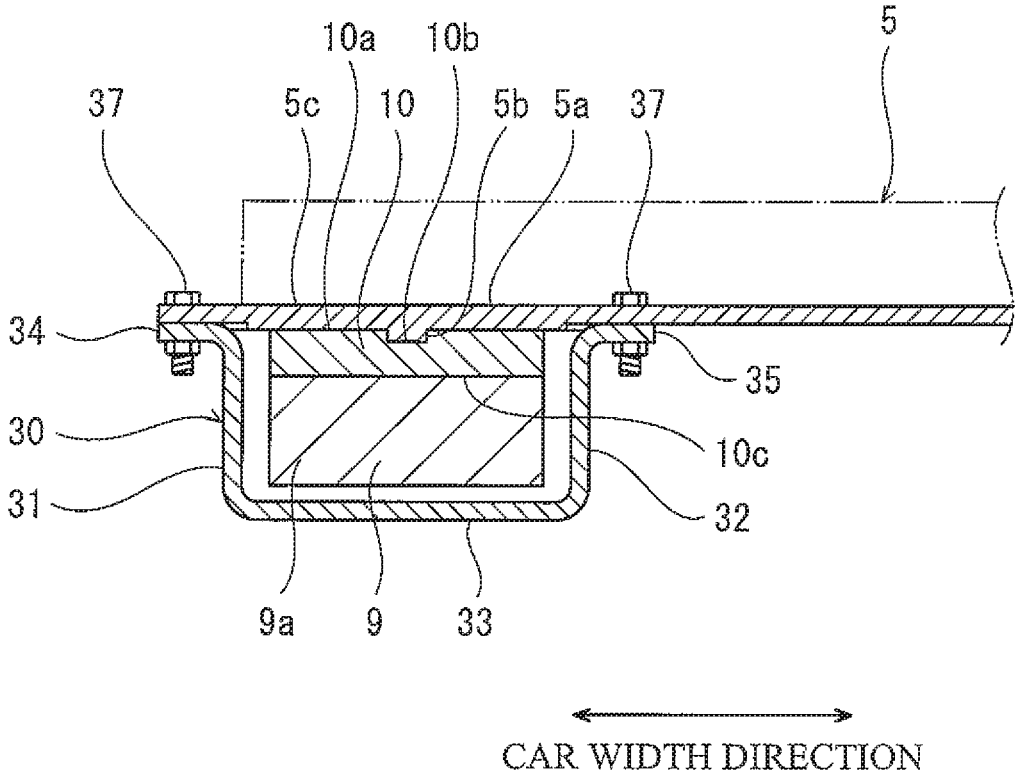
FIG. 3 is a cross sectional view when viewing a middle portion of a plate spring of FIG. 1 and its vicinity from a car longitudinal direction.

FIG. 1 is a side view of a railcar bogie 1 according to Embodiment 1. FIG. 2 is a perspective view when viewing a lifting supporting portion 36 of FIG. 1 and its vicinity from above. FIG. 3 is a cross sectional view when viewing a middle portion 9*a* of a plate spring 9 of FIG. 1 and its vicinity from the car longitudinal direction. As shown in FIG. 1, the railcar bogie 1 includes a bogie frame 4 supporting a carbody (not shown) through an air spring 2 (secondary suspension) and a bolster 3. The bogie frame 4 includes a cross beam 5 but does not include so-called side sills. The cross beam 5 is located at a car longitudinal direction middle of the bogie 1 and extends in the car width direction.

The cross beam 5 is connected to the bolster 3 so as to be turnable relative to the bolster 3. The bolster 3 is connected to the carbody through the air spring 2 and a bolster anchor (not shown). Hanging hooks 22 are provided at the cross beam 5. A pair of wheelsets 6 are arranged at both sides of the cross beam 5 in the car longitudinal direction. Each of the wheelsets 6 includes: an axle 6*a* extending in the car width direction; and wheels 6*b* provided at both respective sides of the axle 6*a* in the car width direction. Both car width direction side portions of the axle 6*a* are rotatably supported by respective bearings 7, and the bearings 7 are accommodated in respective axle boxes 8.

The axle boxes 8 support respective end portions 9*b* of plate springs 9 each extending in the car longitudinal direction. Longitudinal direction middle portions 9*a* of the plate springs 9 support respective car width direction end portions 5*a* of the cross beam 5. To be specific, each of the plate springs 9 is supported by a pair of axle boxes 8 arranged away from each other in the car longitudinal direction at each of both sides of the bogie 1 in the car width direction and supports the bogie frame 4. Therefore, the plate spring 9 has both the function of a primary suspension and the function of a conventional side sill. At least a lower surface of the plate spring 9 contains resin. For example, the plate spring 9 is made of fiber-reinforced resin. The plate spring 9 has a bow shape that is convex downward in a side view of the bogie. The lower surface of the plate spring 9 includes inclined surfaces 9*c* inclined with respect to a horizontal direction when viewed from the car width direction. Each of the inclined surfaces 9*c* of the lower surface of the plate spring 9 is located between the middle portion 9*a* of the plate spring 9 and the end portion 9*b* of the plate spring 9.

The bogie frame 4 includes pressing members 10 each provided at a lower portion of the end portion 5*a* of the cross beam 5. The middle portion 9*a* of the plate spring 9 is located right under the corresponding pressing member 10. The pressing member 10 is a rigid member (for example, a non-elastic member made of metal, fiber-reinforced resin, or the like). An upper surface 10*a* of the pressing member 10 is in contact with a lower surface of the end portion 5*a* of the cross beam 5 from below. The pressing member 10 and the end portion 5*a* of the cross beam 5 are positioned in the horizontal direction by a recess-projection fitting structure. Specifically, a projection 5*b* is formed on the lower surface of the end portion 5*a* of the cross beam 5, and a recess 10*b* to which the projection 5*b* is fitted is formed on the upper surface 10*a* of the pressing member 10. The pressing member 10 includes a lower surface 10*c* having a circular-arc shape that is convex downward in the side view of the bogie. To be specific, in the side view of the bogie, the pressing member 10 has such a shape as to gradually decrease in thickness from a middle portion thereof toward each of both car longitudinal direction end portions thereof. The position of a center of the pressing member 10 in the car longitudinal direction coincides with the position of a center of the plate spring 9 in the car longitudinal direction. The pressing member 10 is shorter than a below-described receiving beam 30 in the car longitudinal direction.

The middle portion 9*a* of the plate spring 9 is located lower than the end portions 9*b*. An upper surface of the middle portion 9*a* of the plate spring 9 has a circular-arc shape that is convex downward in the side view of the bogie. The pressing member 10 is placed on the middle portion 9*a* of the plate spring 9 from above. The pressing member 10 presses an upper surface of the plate spring 9 by gravitational downward load from the cross beam 5 without being fixed to the plate spring 9 so as to be separable from the upper surface of the plate spring 9. To be specific, the pressing member 10 presses the upper surface of the middle portion 9*a* of the plate spring 9 without being connected to the plate spring 9 by a fixture (such as a bolt). In other words, the pressing of the pressing member 10 against the upper surface of the plate spring 9 is kept by the gravitational downward load from the cross beam 5 and reaction force of the plate spring 9. With this, the plate spring 9 can swing while changing a region pressed against the lower surface of the pressing member 10. It should be noted that the bogie frame 4 may be directly or indirectly placed on the upper surface of the middle portion 9*a* of the plate spring 9. A buffer sheet may be interposed between the pressing member 10 and the plate spring 9.

As shown in FIGS. 1 and 2, the axle box 8 is coupled to the bogie frame 4 by a coupling mechanism 11. The coupling mechanism 11 includes an axle beam 12, a core rod 13, an elastic bushing 14, a pair of receiving seats 15, a pair of lid members 16, and a plurality of fastening members 17. To be specific, the bogie 1 is a so-called axle beam type bogie. An upper surface of the axle box 8 is inclined toward a bogie middle side. A spring seat 18 is attached to an upper portion of the axle box 8, and the end portion 9*b* of the plate spring 9 extending in the car longitudinal direction is placed on the spring seat 18 from above so as to be separable from the spring seat 18 without being fixed to the spring seat 18. To be specific, the end portions 9*b* of the plate spring 9 are supported by the respective axle boxes 8 through the spring seats 18. Each of the spring seats 18 includes an elastic body 19 (such as a multi-layer rubber) and a receiving member 20. The elastic body 19 is positioned on the upper surface of the axle box 8. The receiving member 20 is positioned on the elastic body 19, and the end portion 9*b* of the plate spring 9 is placed on the receiving member 20. It should be noted that the plate spring 9 and the receiving member 20 are not fixed to each other.

The axle beam 12 extends in the car longitudinal direction from the axle box 8 to the bogie middle side. A tubular portion 12*a* that is open toward both sides in the car width direction is provided at a tip end of the axle beam 12. The tubular portion 12*a* is arranged under the plate spring 9 so as to overlap the plate spring 9 when viewed from above. The tubular portion 12*a* is formed by fixing a separate semi-tubular portion by bolts to a semi-tubular portion integrally formed at the tip end of the axle beam 12. The core rod 13 is inserted into an internal space of the tubular portion 12*a* in the car width direction. The core rod 13 includes a pair of protruding portions 13*a* projecting toward both sides in the car width direction. The elastic bushing 14 (for example, a rubber bushing) includes a tubular elastic body (for example, rubber) and is interposed between the core rod 13 and the tubular portion 12*a*. The protruding portions 13*a* of the core rod 13 project in the car width direction beyond the tubular portion 12*a* of the axle beam 12.

The pair of receiving seats 15 are provided at the bogie frame 4 and include a pair of grooves 21 recessed downward. The pair of protruding portions 13*a* of the core rod 13 are fitted into the pair of grooves 21 from above. Each of the lid members 16 is fixed to the receiving seat 15 by fastening members 17 (for example, bolts) while pressing, from above, the protruding portion 13*a* accommodated in the groove 21. The bogie frame 4 includes receiving beams 30 extending from the respective end portions 5*a* of the cross beam 5 toward both sides in the car longitudinal direction, and the receiving seats 15 are provided at respective tip ends of the receiving beams 30. To be specific, each receiving beam 30 of the bogie frame 4 is coupled to the corresponding axle box 8 through the corresponding coupling mechanism 11.

As shown in FIGS. 1 to 3, the receiving beam 30 is arranged under the end portion 5*a* of the cross beam 5 and fixed to the cross beam 5. The receiving beam 30 includes a pair of side wall portions 31 and 32, a bottom wall portion 33, and a pair of flange portions 34 and 35. The pair of side wall portions 31 and 32, the bottom wall portion 33, and the pair of flange portions 34 and 35 are formed integrally. The receiving beam 30 is formed by, for example, subjecting a metal plate to press working.

The pair of side wall portions 31 and 32 extend in the car longitudinal direction while being opposed to each other in the car width direction. The middle portion 9*a* of the plate spring 9 is arranged between the pair of side wall portions 31 and 32 and overlaps the side wall portions 31 and 32 when viewed from the car width direction. The plate spring 9 extends in the car longitudinal direction through a space between the pair of side wall portions 31 and 32. Cutouts 31*a* through which a side surface of the plate spring 9 is exposed are formed at the side wall portion 31 so as to be located at both respective sides of the cross beam 5 in the car longitudinal direction. Specifically, the cutouts 31*a* are formed by reducing the heights of both car longitudinal direction end portions of the side wall portion 31 (i.e., by reducing the amounts of upward projections of both car longitudinal direction end portions of the side wall portion 31 from the bottom wall portion 33).

The bottom wall portion 33 connects lower ends of the pair of side wall portions 31 and 32 to each other and covers the plate spring 9 from below. The pair of flange portions 34 and 35 project from respective upper ends of the pair of side wall portions 31 and 32 in respective directions away from each other along the car width direction. The cross beam 5 includes a horizontal plate portion 5*c* at at least the end portion 5*a*. The flange portions 34 and 35 are detachably fixed to the horizontal plate portion 5*c* by fastening members 37 (for example, bolts). The receiving beam 30 does not contact the plate spring 9, i.e., the receiving beam 30 is spaced apart from the plate spring 9.

The pair of receiving seats 15 provided at each car longitudinal direction tip end of the receiving beam 30 are opposed to each other in the car width direction. Each of the pair of receiving seats 15 includes a recess 38 and the groove 21. The recess 38 is formed by recessing an upper end surface of the receiving seat 15 downward and is open toward both sides in the car width direction and an upper side. The recess 38 includes a bottom surface 38*a* and a pair of side surfaces 38*b* extending upward from both respective car longitudinal direction ends of the bottom surface 38*a*.

The groove 21 is formed by recessing part of the bottom surface 38*a* of the recess 38 downward and is open toward both sides in the car width direction and an upper side. A width of the groove 21 in the car longitudinal direction is smaller than a width of the recess 38 in the car longitudinal direction. The protruding portion 13*a* of the core rod 13 is fitted into the groove 21 from above. Each of a contact surface of the protruding portion 13*a* and a contact surface of the groove 21 which surfaces contact each other has a circular-arc shape in the side view of the bogie. With the protruding portion 13*a* fitted into the groove 21, the lid member 16 is accommodated in the recess 38 so as to contact an upper surface of the protruding portion 13*a*.

The lid member 16 is fixed to the receiving seat 15 from above by the fastening members 17 (see FIG. 1), such as bolts, and the protruding portion 13*a* is pressed by the lid member 16 from above. Internal screw holes 39 are formed on the bottom surface 38*a* of the recess 38 so as to be located at both respective sides of the groove 21. The fastening members 17 pass through respective through holes (not shown) of the lid member 16 and are fastened to the respective internal screw holes 39. With this, the core rod 13 is sandwiched by the receiving seats 15 and the lid members 16.

A pair of lifting supporting portions 36 are provided at the receiving beam 30. The pair of lifting supporting portions 36 are arranged at one and the other sides of the cross beam 5 in the car longitudinal direction. The lifting supporting portions 36 are arranged at the bogie middle side of the tubular portions 12*a* of the axle beams 12. The lifting supporting portions 36 are continuous with the side wall portions 31 and 32 and bottom wall portion 33 of the receiving beam 30. A space surrounded by the side wall portions 31 and 32 and the bottom wall portion 33 from three sides and extending in the car longitudinal direction is closed by the lifting supporting portions 36 from an outside in the car longitudinal direction.

Each of the lifting supporting portions 36 projects toward the inclined surface 9*c* of the lower surface of the plate spring 9. An upper end surface of the lifting supporting portion 36 is a supporting surface 36*a* that is opposed to the inclined surface 9*c* of the plate spring 9 from below with a gap S. The gap S is exposed through the cutout 31*a* of the receiving beam 30 when viewed from an outside in the car width direction. To be specific, the gap S is visible from an outside of the bogie 1 in the car width direction. A distance between the supporting surface 36*a* and the plate spring 9 is shorter than a distance between the supporting surface 36*a* and the tubular portion 12*a* of the axle beam 12.

The supporting surface 36*a* of the lifting supporting portion 36 is inclined with respect to the horizontal direction, i.e., inclined along the inclined surface 9*c* of the plate spring 9. The supporting surface 36*a* is, for example, a surface substantially parallel to an opposing portion of the inclined surface 9*c* of the plate spring 9. The supporting surface 36*a* is formed by using a material having lower hardness than the inclined surface 9*c* of the plate spring 9. Specifically, the supporting surface 36*a* is formed by using a soft material that is rubber, elastomer, resin, or cloth. In the present embodiment, as one example, a main body portion of the lifting supporting portion 36 is made of metal, and the soft material, such as rubber, is fixed (adhered) to an upper end of the main body portion of the lifting supporting portion 36. With this, the supporting surface 36*a* made of the soft material is formed.

Figure 4:
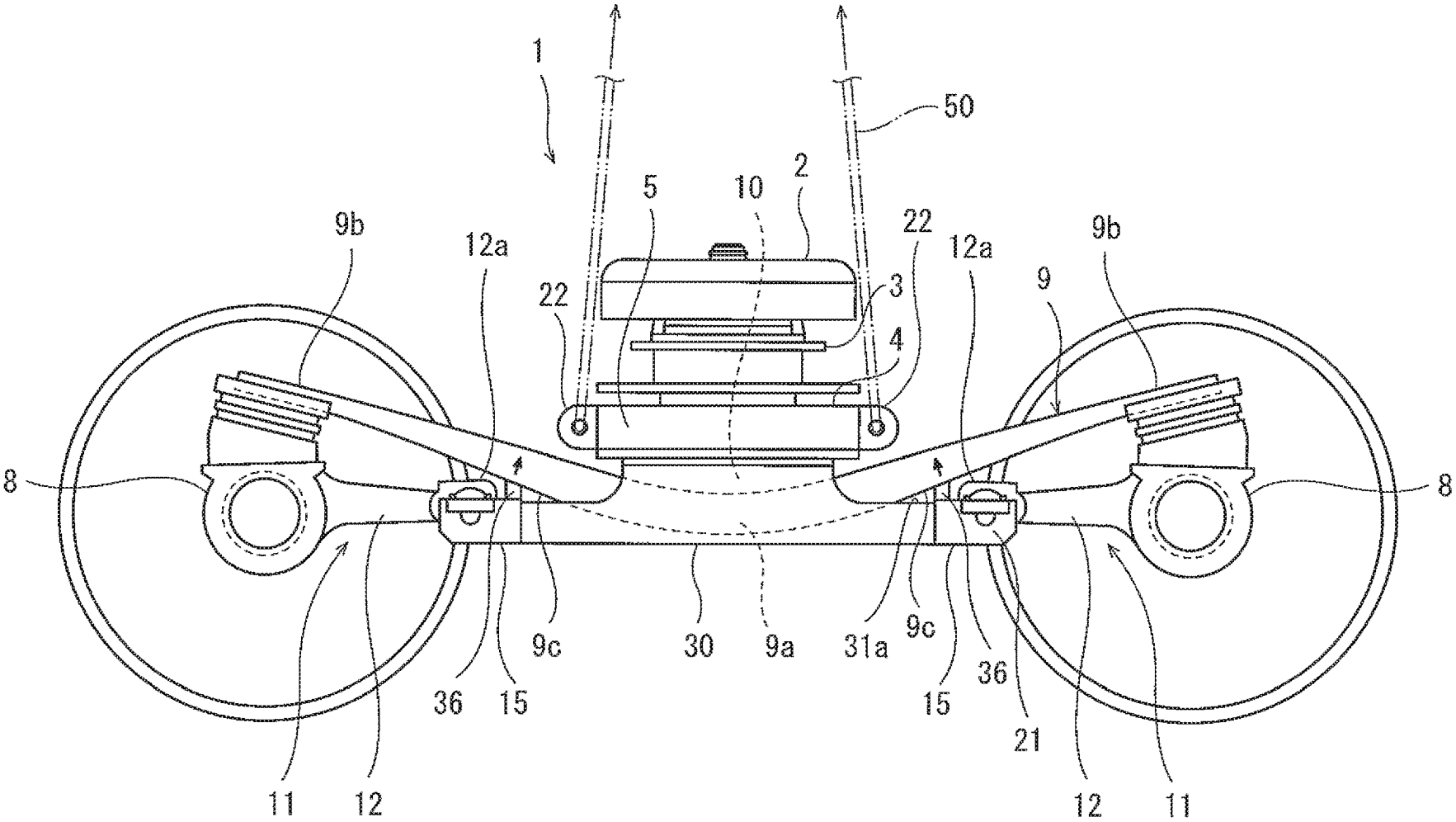
FIG. 4 is a side view showing a state where the bogie of FIG. 1 is lifted.

FIG. 4 is a side view showing a state where the bogie 1 of FIG. 1 is lifted. As shown in FIG. 4, when lifting the bogie 1, a lifting rope 50 is inserted into holes of the hanging hooks 22 of the bogie frame 4, and the rope 50 is pulled upward with a crane or the like. In this case, since the plate spring 9 is not fixed to the bogie frame 4, the pressing member 10 separates upward from the plate spring 9 in accordance with the upward movement of the bogie frame 4. However, since the lifting supporting portions 36 integrated with the cross beam 5 move upward by the upward movement of the bogie frame 4, the soft supporting surfaces 36*a* of the lifting supporting portions 36 are brought into surface contact with the inclined surfaces 9*c* of the lower surface of the plate spring 9 from below. Therefore, when lifting the bogie frame 4, the plate springs 9 are also lifted while being supported by the supporting surfaces 36*a*.

According to the above-described configuration, when the bogie frame 4 is lifted with a crane or the like, the inclined supporting surfaces 36*a* of the lifting supporting portions 36 of the bogie frame 4 are brought into surface contact with the inclined surfaces 9*c* of the lower surfaces of the plate springs 9 to stably support the plate springs 9, and strong stress is prevented from being locally generated at the plate springs 9. Thus, the plate spring 9 is prevented from being damaged. In addition, since work of attaching and detaching a protective member when lifting the bogie is unnecessary, the work property can be prevented from deteriorating.

The supporting surface 36*a* is formed by using a material having lower hardness than the inclined surface 9*c* of the plate spring 9. Therefore, even when the inclined surface 9*c* of the plate spring 9 is strongly pressed against the supporting surface 36*a*, the plate spring 9 can be prevented from being damaged.

The supporting surface 36*a* of the lifting supporting portion 36 supports the inclined surface 9*c* located between the middle portion 9*a* and the end portion 9*b* in the plate spring 9 having the bow shape that is convex downward. Therefore, support stability when lifting the bogie improves. Further, the pair of lifting supporting portions 36 are arranged at one and the other sides of the cross beam 5 in the car longitudinal direction. Therefore, an interval for supporting the plate spring 9 is wide in the car longitudinal direction, and thus, the support stability when lifting the bogie improves.

When lifting the bogie, the disappearance of the gap S between the inclined surface 9*c* of the plate spring 9 and the supporting surface 36*a* of the lifting supporting portion 36 can be visually confirmed from the outside in the car width direction through the cutout 31*a* of the side wall portion 31 of the receiving beam 30. Therefore, the work of lifting the bogie can be surely performed. The supporting surface 36*a* is formed by using a material that is rubber, elastomer, resin, or cloth, and the soft material is pressed against the inclined surface 9*c* of the plate spring 9 when the bogie is lifted. Therefore, local stress generated on the resin lower surface of the plate spring 9 can be suitably reduced.

Embodiment 2

Figure 5:
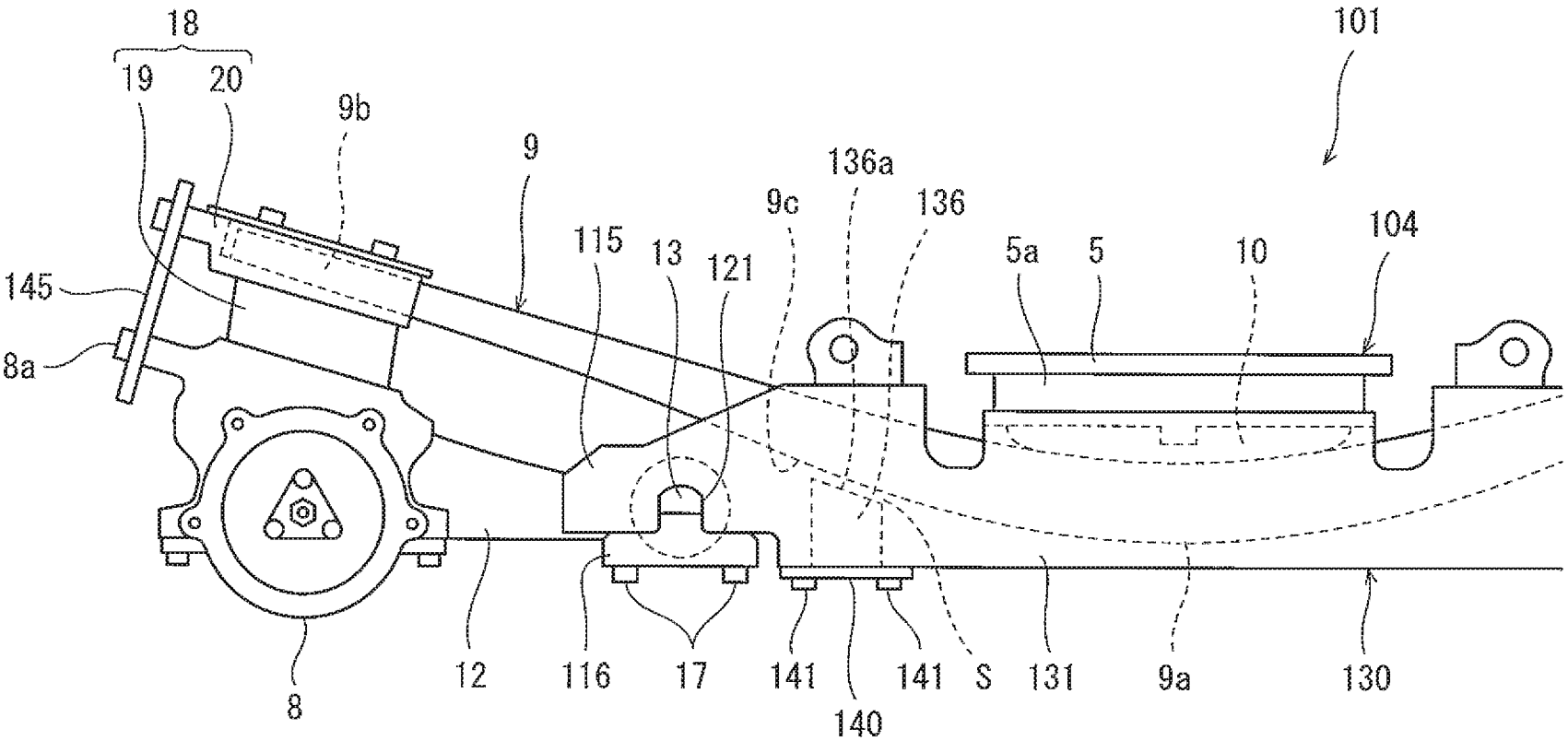
FIG. 5 is a side view showing major components of the railcar bogie according to Embodiment 2.
Figure 6:
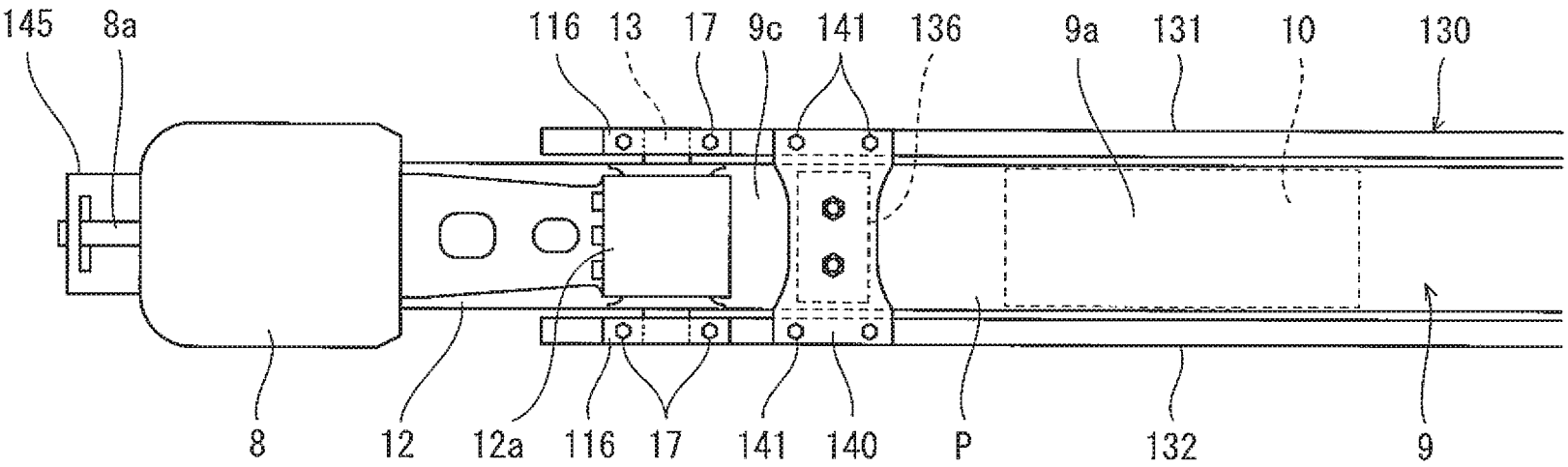
FIG. 6 is a bottom view of the bogie shown in FIG. 5.

FIG. 5 is a side view showing major components of a railcar bogie 101 according to Embodiment 2. FIG. 6 is a bottom view of the bogie 101 shown in FIG. 5. The same reference signs are used for the same components as in Embodiment 1, and a repetition of the same explanation is avoided. As shown in FIGS. 5 and 6, the bogie 101 includes a bogie frame 104, and the bogie frame 104 includes the cross beam 5 and receiving beams 130 extending from the respective car width direction end portions 5*a* of the cross beam 5 in the car longitudinal direction. The receiving beam 130 includes a pair of side wall portions 131 and 132 extending in the car longitudinal direction at both respective sides of the plate spring 9 in the car width direction. A plate spring space P between the side wall portions 131 and 132 is open downward. To be specific, the receiving beam 130 has an inverted concave cross section when viewed from the car longitudinal direction. Therefore, when assembling the bogie, the plate spring 9 is accessible to the plate spring space P through the lower opening of the receiving beam 130.

Receiving seats 115 are provided at respective car longitudinal direction tip end portions of the side wall portions 131 and 132, and grooves 121 that are recessed upward are formed at the respective receiving seats 115. The core rod 13 is fitted into a pair of grooves 121 from below. Each of lid members 116 is fixed to the receiving seat 115 by the bolts 17 while pressing the core rod 13 from below. To be specific, although the direction in which the core rod 13 is fitted to the grooves 121 is opposite to the direction in Embodiment 1 in the upper-lower direction, the bogie 101 of Embodiment 2 is also an axle beam type bogie.

A bottom plate 140 that closes the plate spring space P from below is detachably attached to the side wall portions 131 and 132. The bottom plate 140 is arranged at the bogie middle side of the lid member 116 in the car longitudinal direction and arranged at an outside of the middle of the plate spring 9 in the car longitudinal direction. The bottom plate 140 is fixed to lower end surfaces of the side wall portions 131 and 132 from below by bolts 141.

A lifting supporting portion 136 projecting toward the inclined surface 9*c* of the lower surface of the plate spring 9 is provided on an upper surface of the bottom plate 140. An upper end surface of the lifting supporting portion 136 is a supporting surface 136*a* that is opposed to the inclined surface 9*c* of the plate spring 9 from below with the gap S.

Figure 7:
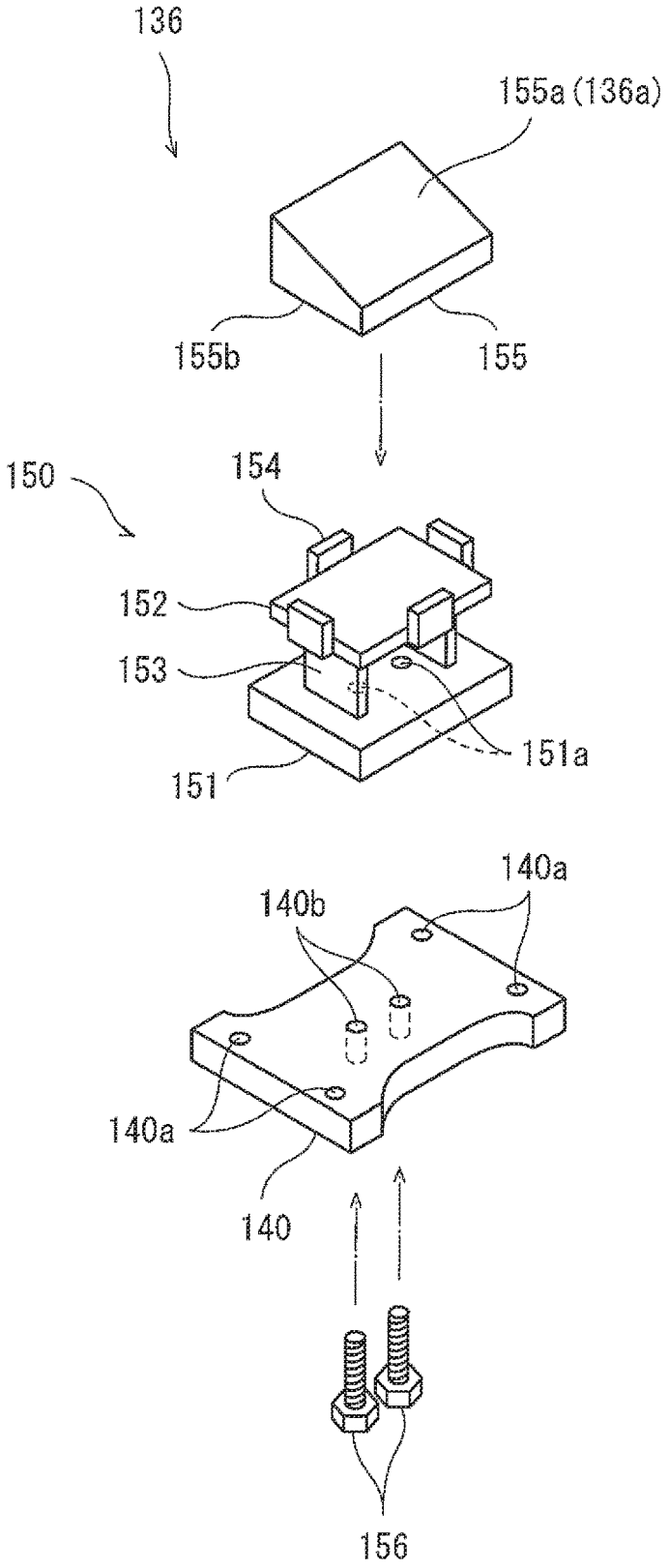
FIG. 7 is an exploded perspective view showing the lifting supporting portion shown in FIG. 5.

FIG. 7 is an exploded perspective view of the lifting supporting portion 136 shown in FIG. 5. As shown in FIG. 7, the lifting supporting portion 136 is a split type and is divided into a base 150 and a contact member 155 attached to the base 150. First fastening holes 140*a* and second fastening holes 140*b* are formed at the bottom plate 140. The first fastening holes 140*a* are used when the bottom plate 140 is fixed to the side wall portions 131 and 132 (see FIGS. 5 and 6) by the bolt 141. The second fastening holes 140*b* are used when the base 150 is fixed to the bottom plate 140 by bolts 156.

The base 150 is made of metal, and the contact member 155 is formed by using a material having lower hardness than the plate spring 9. Specifically, the contact member 155 is formed by using a soft material that is rubber, elastomer, synthetic resin, or cloth. The base 150 includes a lower plate portion 151, an upper plate portion 152, post portions 153, and side plate portions 154. The lower plate portion 151 includes fastening holes 151*a* used to fix the base 150 to the bottom plate 140. The upper plate portion 152 is separated upward from the lower plate portion 151. The post portions 153 couple the lower plate portion 151 and the upper plate portion 152. The side plate portions 154 project upward from a side portion of the upper plate portion 152. The bolts 156 fix the base 150 to the bottom plate 140 by being inserted into the second fastening holes 140*b* of the bottom plate 140 and the fastening holes 151*a* of the lower plate portion 151.

An upper surface 155*a* of the contact member 155 is inclined with respect to a lower surface 155*b* of the contact member 155. To be specific, the contact member 155 has such a shape as to gradually increase in thickness from one end thereof to the other end thereof. The upper surface 155*a* of the contact member 155 serves as the supporting surface 136*a* of the lifting supporting portion 136. The contact member 155 is provided in a recessed accommodating space formed by the upper plate portion 152 and side plate portions 154 of the base 150. With this, the contact member 155 is positioned in the horizontal direction and the vertical direction by the upper plate portion 152 and the side plate portions 154 while projecting upward beyond the side plate portions 154. It should be noted that since the other components are the same as those of Embodiment 1, explanations thereof are omitted.

Figure 8:
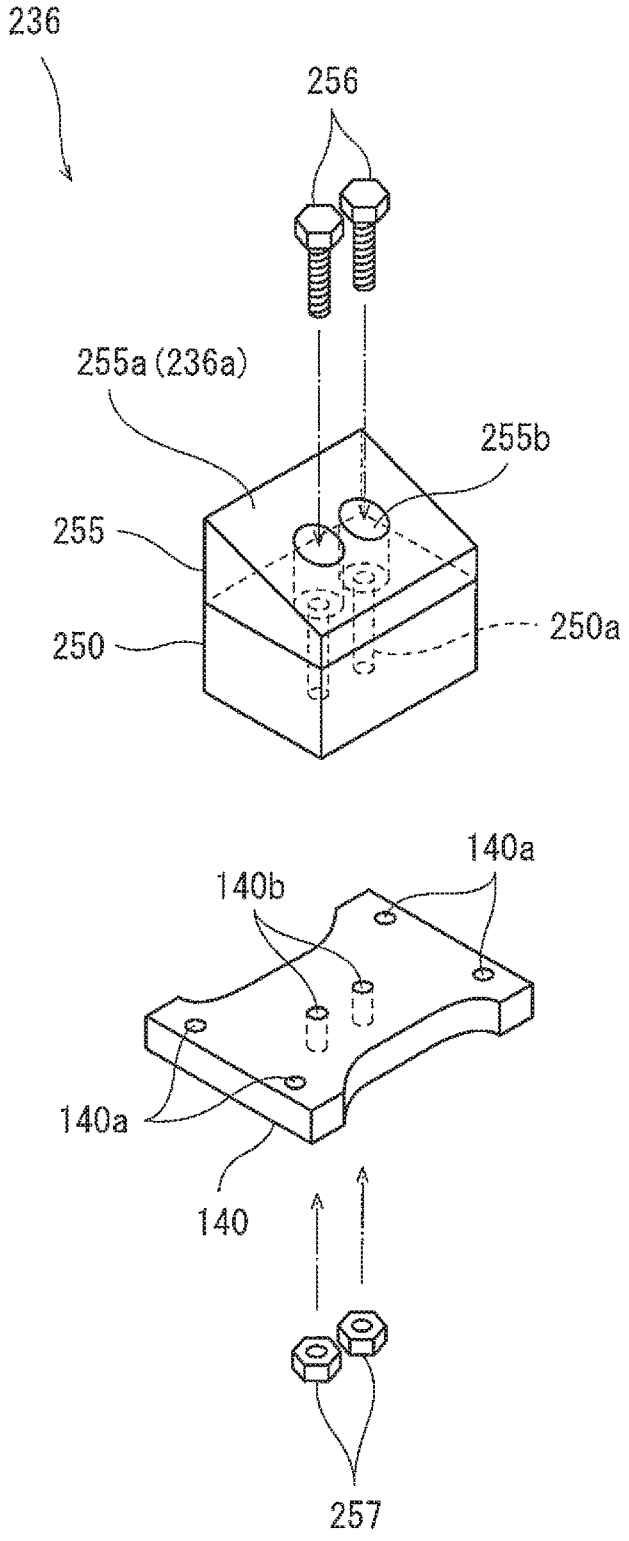
FIG. 8 is an exploded perspective view showing the lifting supporting portion according to a modified example.

FIG. 8 is an exploded perspective view of a lifting supporting portion 236 according to a modified example. As shown in FIG. 8, the lifting supporting portion 236 is an integrated type (non-split type). The lifting supporting portion 236 is formed by integrating a contact portion 255 with an upper surface of a base portion 250. Specifically, the base portion 250 is made of metal, and the contact portion 255 is formed by using a soft material that is rubber, elastomer, synthetic resin, or cloth. The base portion 250 and the contact portion 255 are adhered to each other. For example, when the contact portion 255 is made of rubber, the contact portion 255 is vulcanized and adhered to the upper surface of the base portion 250.

Fastening holes 250*a* communicating with the respective second fastening holes 140*b* of the bottom plate 140 are formed at the base portion 250. Insertion holes 255*b* communicating with and larger in diameter than the respective fastening holes 250*a* are formed at the contact portion 255. Each insertion hole 255*b* of the contact portion 255 is larger in diameter than a head portion of a bolt 256, and each fastening hole 250*a* of the base portion 250 is larger in diameter than a shaft portion of the bolt 256 but smaller in diameter than the head portion of the bolt 256.

The bolts 256 are inserted through the insertion holes 255*b* of the contact portion 255 into the fastening holes 250*a* of the base portion 250 and the second fastening holes 140*b* of the bottom plate 140 from above and then fastened to nuts 257 arranged under the bottom plate 140. With this, the lifting supporting portion 236 is fixed to the bottom plate 140. An upper surface 255*a* of the contact portion 255 is a supporting surface 236*a* inclined with respect to the horizontal direction, i.e., inclined along the inclined surface 9*c* (see FIG. 5) of the plate spring 9.

Figure 9:
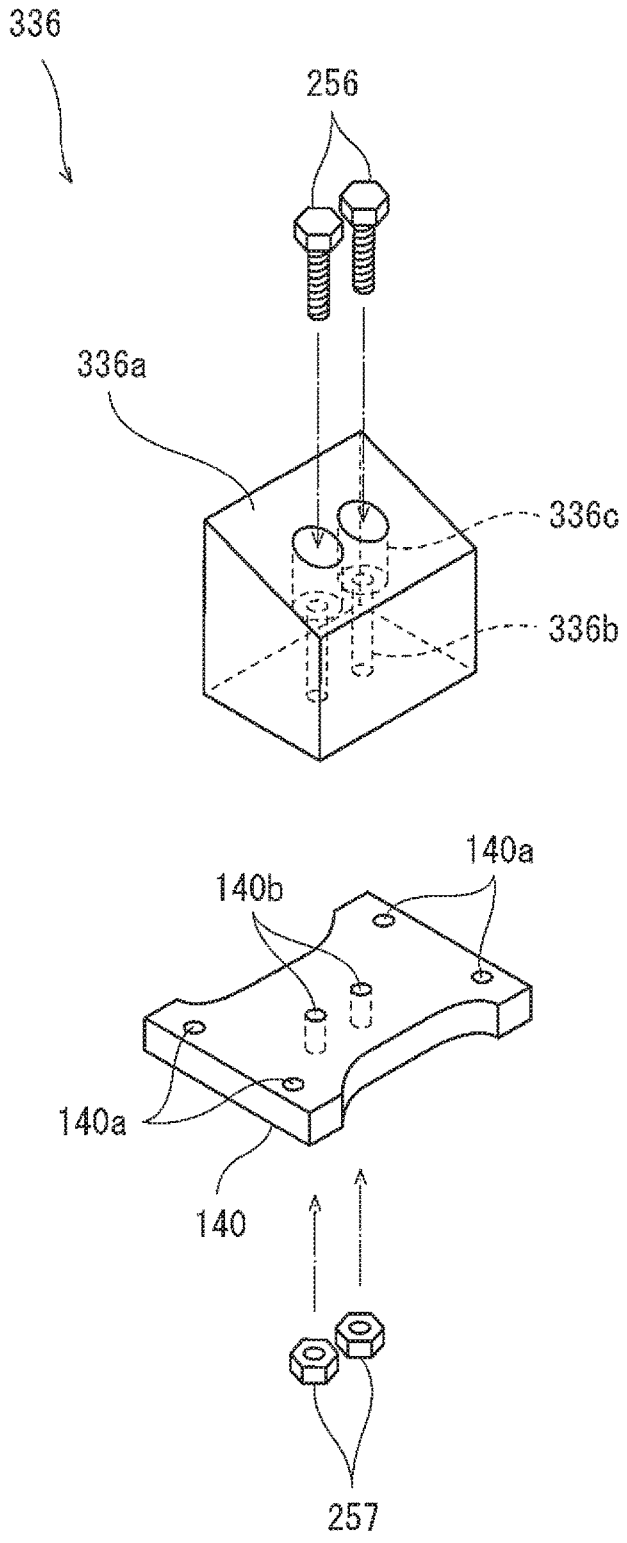
FIG. 9 is an exploded perspective view showing the lifting supporting portion according to another modified example.

FIG. 9 is an exploded perspective view of a lifting supporting portion 336 according to another modified example. As shown in FIG. 9, the entire lifting supporting portion 336 is formed by using a material having lower hardness than the plate spring 9. Specifically, the lifting supporting portion 336 is formed by a material that is synthetic resin, rubber, or elastomer. Fastening holes 336*b* and insertion holes 336*c* are formed at the lifting supporting portion 336. The fastening holes 336*b* communicate with the respective second fastening holes 140*b* of the bottom plate 140, and the insertion holes 336*c* communicates with the respective fastening holes 336*b* and are larger in diameter than the fastening holes 336*b*. Each insertion hole 336*c* is larger in diameter than the head portion of the bolt 256, and each fastening hole 336*b* is larger in diameter than the shaft portion of the bolt 256 but smaller in diameter than the head portion of the bolt 256.

The bolts 256 are inserted through the insertion holes 336*c* of the lifting supporting portion 336 into the fastening holes 336*b* and the second fastening holes 140*b* of the bottom plate 140 from above and then fastened to the nuts 257 arranged under the bottom plate 140. With this, the lifting supporting portion 336 is fixed to the bottom plate 140. An upper surface of the lifting supporting portion 336 is a supporting surface 336*a* inclined with respect to the horizontal direction, i.e., inclined along the inclined surface 9*c* (see FIG. 5) of the plate spring 9.

The present invention is not limited to the above embodiments, and modifications, additions, and eliminations may be made with respect to the configurations of the embodiments. The plate spring 9 may be formed such that: a resin sheet is attached to the lower surface of the fiber-reinforced resin; or the lower surface of the plate spring 9 is made of resin, and an inside of the plate spring 9 is made of a non-resin material (for example, metal). The supporting surface 36*a* may be formed by coating the supporting portion main body with resin, instead of attaching the soft material, such as rubber, to the supporting portion main body. The axle box support type is not limited to the axle beam type, and a mechanism of coupling the axle box and the bogie frame is only required to be included. The bogie may be a bolsterless bogie instead of a bogie with a bolster.

If the bogie lifting work by the method of lifting the bogie frame is not performed regularly but is performed only in an emergency, such as in derailment recovery work, the low-hardness material does not necessarily have to be used for the supporting surface 36*a*, and the soft material or the resin coating does not necessarily have to be provided on the supporting surface 36*a*. In this case, the soft material may be inserted between the inclined surface 9*c* of the plate spring 9 and the supporting surface 36*a* of the lifting supporting portion 36 only during the bogie lifting work. With this, as compared to a case where the low-hardness material is used, or the soft material or the resin coating is permanently provided, the number of parts can be reduced, and the manufacturing cost can be reduced.

REFERENCE SIGNS LIST

1, 101 bogie
4 bogie frame
5 cross beam
6*a* axle
7 bearing
8 axle box
9 plate spring
9*a* middle portion
9*b* end portion
9*c* inclined surface
10 pressing member
11 coupling mechanism
12 axle beam
30, 130 receiving beam
31, 32, 131, 132 side wall portion
31*a* cutout
36, 136, 236, 336 lifting supporting portion
36*a*, 136*a*, 236*a*, 336*a* supporting surface
140 bottom plate
S gap
P plate spring space

The invention claimed is:

1. A railcar bogie comprising:

a bogie frame including a cross beam and pressing members, the pressing members being respectively provided at both car width direction end portions of the cross beam;

a plurality of axle boxes accommodating a plurality of bearings supporting a pair of axles;

a plurality of coupling mechanisms coupling the plurality of axle boxes to the bogie frame; and a plate spring extending in a car longitudinal direction and supported by a pair of axle boxes arranged away from each other in the car longitudinal direction among the plurality of axle boxes, the plate spring supporting the cross beam while being pressed by a corresponding one of the pressing members from above such that the corresponding pressing member is separable from the plate spring, at least a lower surface of the plate spring containing resin, wherein:

the lower surface of the plate spring includes an inclined surface inclined with respect to a horizontal direction when viewed from a car width direction;

the bogie frame includes at least one lifting supporting portion, each of which includes a supporting surface opposed to the inclined surface of the plate spring from below with a gap and inclined along the inclined surface of the plate spring;

the bogie frame further includes a receiving beam extending from the cross beam in the car longitudinal direction, a tip end of the receiving beam being provided at a receiving seat; and the supporting surface of a said lifting supporting portion is higher than a surface of the receiving seat located directly below said lifting supporting portion.

2. The railcar bogie according to claim 1, wherein the supporting surface of each of the at least one lifting supporting portion comprises a material having lower hardness than the inclined surface of the plate spring.

3. The railcar bogie according to claim 1, wherein:

the plate spring has a bow shape that is convex downward when viewed from the car width direction of the bogie; and the inclined surface of the plate spring is located between a middle portion of the plate spring and an end portion of the plate spring.

4. The railcar bogie according to claim 1, wherein the at least one lifting supporting portion comprises a pair of lifting supporting portions arranged at one and the other sides of the cross beam in the car longitudinal direction.

5. The railcar bogie according to claim 1, wherein the supporting surface of each of the at least one lifting supporting portion comprises a material that is rubber, elastomer, resin, or cloth.

6. A railcar bogie comprising:

a bogie frame including a cross beam and pressing members, the pressing members being respectively provided at both car width direction end portions of the cross beam;

a plurality of axle boxes accommodating a plurality of bearings supporting a pair of axles;

a plurality of coupling mechanisms coupling the plurality of axle boxes to the bogie frame; and a plate spring extending in a car longitudinal direction and supported by a pair of axle boxes arranged away from each other in the car longitudinal direction among the plurality of axle boxes, the plate spring supporting the cross beam while being pressed by a corresponding one of the pressing members from above such that the corresponding pressing member is separable from the plate spring, at least a lower surface of the plate spring containing resin, wherein:

the lower surface of the plate spring includes an inclined surface inclined with respect to a horizontal direction when viewed from a car width direction;

the bogie frame includes at least one lifting supporting portion, each of which includes a supporting surface opposed to the inclined surface of the plate spring from below with a gap and inclined along the inclined surface of the plate spring;

the bogie frame includes a receiving beam extending from the cross beam in the car longitudinal direction to be connected to ones of the coupling mechanisms;

the receiving beam includes a pair of side wall portions extending in the car longitudinal direction at both respective sides of the plate spring in the car width direction; and a cutout through which the gap between the inclined surface of the plate spring and the supporting surface of a said lifting supporting portion is exposed when viewed from the car width direction is formed on at least one of the pair of side wall portions.

7. A railcar bogie comprising:

a bogie frame including a cross beam and pressing members, the pressing members being respectively provided at both car width direction end portions of the cross beam;

a plurality of axle boxes accommodating a plurality of bearings supporting a pair of axles;

a plurality of coupling mechanisms coupling the plurality of axle boxes to the bogie frame; and a plate spring extending in a car longitudinal direction and supported by a pair of axle boxes arranged away from each other in the car longitudinal direction among the plurality of axle boxes, the plate spring supporting the cross beam while being pressed by a corresponding one of the pressing members from above such that the corresponding pressing member is separable from the plate spring, at least a lower surface of the plate spring containing resin, wherein:

the lower surface of the plate spring includes an inclined surface inclined with respect to a horizontal direction when viewed from a car width direction;

the bogie frame includes at least one lifting supporting portion, each of which includes a supporting surface opposed to the inclined surface of the plate spring from below with a gap and inclined along the inclined surface of the plate spring;

the bogie frame includes a receiving beam extending from the cross beam in the car longitudinal direction to be connected to ones of the coupling mechanisms;

the receiving beam includes a pair of side wall portions extending in the car longitudinal direction at both respective sides of the plate spring in the car width direction, a plate spring space between the pair of side wall portions being open downward;

a bottom plate that closes the plate spring space from below is detachably attached to the pair of side wall portions; and a said lifting supporting portion is provided on an upper surface of the bottom plate.

8. The railcar bogie according to claim 1, wherein:

a said coupling mechanism includes an axle beam that extends in the car longitudinal direction from a said axle box to a middle of the bogie, a tip end of the axle beam including a tubular portion that is open toward both sides in the car width direction; and the said lifting supporting portion is arranged toward the middle of the bogie relative to the tubular portion of the axle beam.

9. The railcar bogie according to claim 8, wherein:

a distance between the supporting surface of the said lifting supporting portion and the plate spring is shorter than a distance between the supporting surface and the tubular portion of the axle beam.

10. The railcar bogie according to claim 1, wherein each of the plurality of coupling mechanisms comprises at least one of (i) an axle beam, (ii) a core rod, (iii) an elastic bushing, (iv) the receiving seat, (v) a lid, and (vi) a fastener.

11. The railcar bogie according to claim 6, wherein each of the plurality of coupling mechanisms comprises at least one of (i) an axle beam, (ii) a core rod, (iii) an elastic bushing, (iv) a receiving seat, (v) a lid, and (vi) a fastener.

12. The railcar bogie according to claim 7, wherein each of the plurality of coupling mechanisms comprises at least one of (i) an axle beam, (ii) a core rod, (iii) an elastic bushing, (iv) a receiving seat, (v) a lid, and (vi) a fastener.

* * * * *